US007011001B2

(12) United States Patent
Knox et al.

(10) Patent No.: US 7,011,001 B2
(45) Date of Patent: Mar. 14, 2006

(54) TORQUE WRENCH

(75) Inventors: Michael E. Knox, Manhasset, NY (US); Yanko Chen, Avenel, NJ (US)

(73) Assignee: Mode 1 Corporation, Manhasset, NY (US)

( * ) Notice: Subject to any disclaimer, the term of this patent is extended or adjusted under 35 U.S.C. 154(b) by 3 days.

(21) Appl. No.: 10/681,459

(22) Filed: Oct. 7, 2003

(65) Prior Publication Data

US 2005/0072277 A1 Apr. 7, 2005

(51) Int. Cl.
*B25B 23/14* (2006.01)

(52) U.S. Cl. ..... 81/467; 81/476

(58) Field of Classification Search ..... 81/467, 81/472–476

See application file for complete search history.

(56) References Cited

U.S. PATENT DOCUMENTS 2,378,956 A 6/1945 Thorner
2,690,090 A 9/1954 Pederson
2,734,412 A 2/1956 Orner
2,977,832 A 4/1961 Bless
4,552,042 A * 11/1985 Beymer ..... 81/476
5,497,682 A 3/1996 Hsu
5,662,012 A 9/1997 Grabovac
5,813,298 A 9/1998 Beattie
5,974,919 A * 11/1999 Habele ..... 81/470
6,840,138 B1 * 1/2005 Graffin ..... 81/467

* cited by examiner

*Primary Examiner*—Hadi Shakeri
(74) *Attorney, Agent, or Firm*—Herbert F. Ruschmann

(57) ABSTRACT

A torque device includes a housing rotatably accepting an inner ring assembly having a pin eccentrically disposed relative to a torque axis. A movable member is slidably or pivotably disposed in the housing to come into and out of engagement with the pin when the inner ring assembly rotates relative the housing. The movable member has a slanted face for engaging the pin. The pin and the slanted face are alternatively interchanged in position on the inner ring assembly and movable member. An adjustable biasing device biases the movable member. The biasing device includes a split ring spring and a ring segment spring. Alternatively, the biasing device includes a compression spring.

41 Claims, 14 Drawing Sheets

TORQUE WRENCH

BACKGROUND OF THE INVENTION

The present invention relates to a torque wrench and, more particularly, to a torque wrench capable of tightening threaded assemblies to precise torque levels and which is compact. Furthermore, the torque wrench has an adjustable biasing mechanism for biasing a movable member to effect adjustment of torque applied to the threaded assemblies.

Microwave and radio frequency (RF) equipment utilize threaded connectors which are manufactured to tight tolerances in order to provide precise connection of electrical components and cables. This is necessary to ensure that the electrical connection does not adversely affect electrical signals traveling through the connection by causing reflections resulting in a voltage standing wave ratio (VSWR) which is greater than specifications permit. In order to ensure a proper connection it is often necessary to tighten mating connectors to a precise torque value. This torque setting prevents damage to the components and allows repeatable measurements.

A process for a typical attachment of a device to equipment, in particular test equipment, requires that an operator hand-tighten a connector nut until the last quarter turn and then use a standard open-end torque wrench to precisely tighten the connector nut to a required torque value. After a measurement is made, the connector nut is then loosened with a open-end fixed wrench until the device is free. Typical torque settings are 5, 8 and 12 lb-in.

SUMMARY OF THE INVENTION

Accordingly, it is an object of the invention to provide a torque device which overcomes the drawbacks of the prior art by providing a compact design while permitting accurate adjustment of torque and minimizing parts and assembly and manufacturing requirements.

Briefly stated a torque device of the present invention includes a housing rotatably accepting an inner ring assembly having a pin eccentrically disposed relative to a torque axis. A movable member is slidably or pivotably disposed in the housing to come into and out of engagement with the pin when the inner ring assembly rotates relative the housing. The movable member has a slanted face for engaging the pin. The pin and the slanted face are alternatively interchanged in positions on the inner ring assembly and movable member. An adjustable biasing device biases the movable member. The biasing device includes a split ring spring and a ring segment spring. Alternatively, the biasing device includes a compression spring.

In accordance with these and other objects of the invention, there is provided a housing, and an inner ring assembly defining a torque axis upon which torque is to be applied, the inner ring assembly including at least one pin eccentrically disposed relative to the torque axis and an engaging structure coaxially disposed relative the torque axis for engaging a rotatable member to be tightened. The housing rotatably accepts the inner ring assembly to permit rotation about the torque axis. A movable member is disposed in the housing to move along a travel path to come into and out of engagement with the at least one pin when the inner ring assembly rotates relative to the housing to rotate the at least one pin along a circumferential path of travel about the torque axis and relative to the housing. The movable member has a slanted face slanted relative to a tangent to an intersection of the circumferential path of travel of the at least one pin and a center line of the movable member in a moving direction thereof such that continued rotation in a first direction of the inner ring assembly, relative to the housing, engages the slanted face with the at least one pin and urges the movable member outward relative to the torque axis to a disengagement point where the at least one pin moves out of engagement with the slanted face. An adjustable biasing device is provided for biasing the movable member toward the at least one pin such that the inner ring assembly applies a predetermined level of torque to the rotatable member at the point of disengagement.

According to a feature of the invention, there is further provided an embodiment wherein the movable member is a sliding member slidably disposed in the housing. Alternatively, the movable member may be embodied as a pivoting member pivotally disposed in the housing.

According to a further feature of the invention, there is further provided in the above embodiment a configuration wherein the adjustable biasing device includes a split ring spring, the housing defines a slide notch for slidably accepting the sliding member, and the housing further defines a circumferential opening accepting the split ring spring such that the split ring spring is disposed around the inner ring assembly and an inner circumference of the split ring spring engages a sliding member end of the sliding member, opposing the slanted face, to apply bias to the sliding member to engage the at least one pin with the slanted face.

There is still further provided the feature that the split ring spring is integral with the sliding member in any of the embodiments recited herein including the split ring spring.

A further feature of the invention includes the biasing device described above having a ring segment spring having first and second ends, the ring segment spring being disposed in the circumferential opening radially outside of the split ring spring with the first and second ends engaging an outer circumference of the split ring spring at first and second points, and the biasing device further including a threaded member threaded into the housing and disposed to adjustably apply pressure to the ring segment spring such that the first and second ends of the ring segment spring apply adjustable pressure to the first and second points on the outer circumference of the split ring spring.

Yet another feature of the present invention includes the at least one pin being rotatably disposed in the inner ring assembly and the inner ring assembly including a plurality of the rotatable pins.

In yet another embodiment of the present invention the torque device includes the housing defining a slide notch for slidably accepting the movable member, the movable member being a sliding member slidably disposed in the slide notch defined by the housing and the sliding member having a longitudinal slot aligned along a sliding axis of the sliding member, a guide pin disposed in the housing and within the longitudinal slot, and the slide notch being configured to restrict sliding movement of the sliding member to a linear path when rotation of the inner ring assembly is relative to the housing in the first direction and configured to permit rotation of the sliding member about the guide pin by engagement of the at least one pin with the sliding member with rotation of the inner ring assembly in a second direction, opposite the first direction, such that disengagement of the sliding member with the at least one pin is permitted by continued rotation of the inner ring assembly in the second direction thereby effecting ratcheting operation of the inner ring assembly relative to the housing. This embodiment may incorporate any of the biasing arrangements described herein.

Still another feature of the present invention includes the adjustable biasing device including a threaded member and a compression spring with the threaded member disposed to adjustably apply force to the compression spring which in turn applies the bias to the movable member in any of the embodiments of the movable member.

Yet another embodiment of the present invention includes a torque device for applying torque to a rotatable member, having a housing, an inner ring assembly defining a torque axis upon which torque is to be applied, the inner ring assembly including at least one first engaging surface eccentrically disposed relative to the torque axis and an engaging structure coaxially disposed relative the torque axis for engaging and applying torque to a rotatable member, the housing rotatably accepting the inner ring assembly to permit rotation about the torque axis, a movable member disposed in the housing and having a second engaging surface disposed to move along a travel path to come into and out of engagement with the at least one first engaging surface when the inner ring assembly rotates relative the housing to rotate the a least one first engaging surface along a circumferential path of travel about the torque axis and relative to the housing, the first and second engaging surfaces being disposed to effect engagement along a surface path slanted relative to a tangent to an intersection of the circumferential path of travel of the first engaging surface and a center line of the movable member in a moving direction thereof such that continued rotation in a first direction of the inner ring assembly, relative to the housing, engages the second engaging surface with the at least one first engaging surface and urges the movable member outward relative to the torque axis to a disengagement point where the second engaging surface moves out of engagement with the at least one first engaging surface, and an adjustable biasing device for biasing the movable member toward the at least one first engaging surface such that the inner ring assembly applies a predetermined level of torque to the rotatable member at the point of disengagement.

In the above embodiments the movable member is optionally a sliding member slidably disposed in the housing or a pivoting member. Furthermore, the second engaging surface is optionally a surface of a pin rotatably disposed in the sliding member and the at least one first engaging surface is optionally a surface disposed at an incline relative to a radial direction of the inner ring assembly. Alternatively, the movable member is a pivoting member pivotably disposed in the housing optionally incorporating a rotatable pin.

Yet another embodiment of the present invention includes any of the embodiments of the torque device describe above being incorporated into an electrical connector wherein the rotatable member is a nut, or rotating threaded connecting collar, of the electrical connector and the engaging structure of the inner ring assembly is integral with the nut thereby providing an electrical connector with a torque limiting function. In one embodiment the electrical connector is part of a cable assembly. In another embodiment the electrical connector is provided on a piece of electrical equipment, such as a test instrument for example, or an adaptor for female-female, male-male, or male-female connections.

The above, and other objects, features and advantages of the present invention will become apparent from the following description read in conjunction with the accompanying drawings, in which like reference numerals designate the same elements. The present invention is considered to include all functional combinations of the above described features and is not limited to the particular structural embodiments shown in the figures as examples.

DETAILED DESCRIPTION OF THE INVENTION

Figure 1:
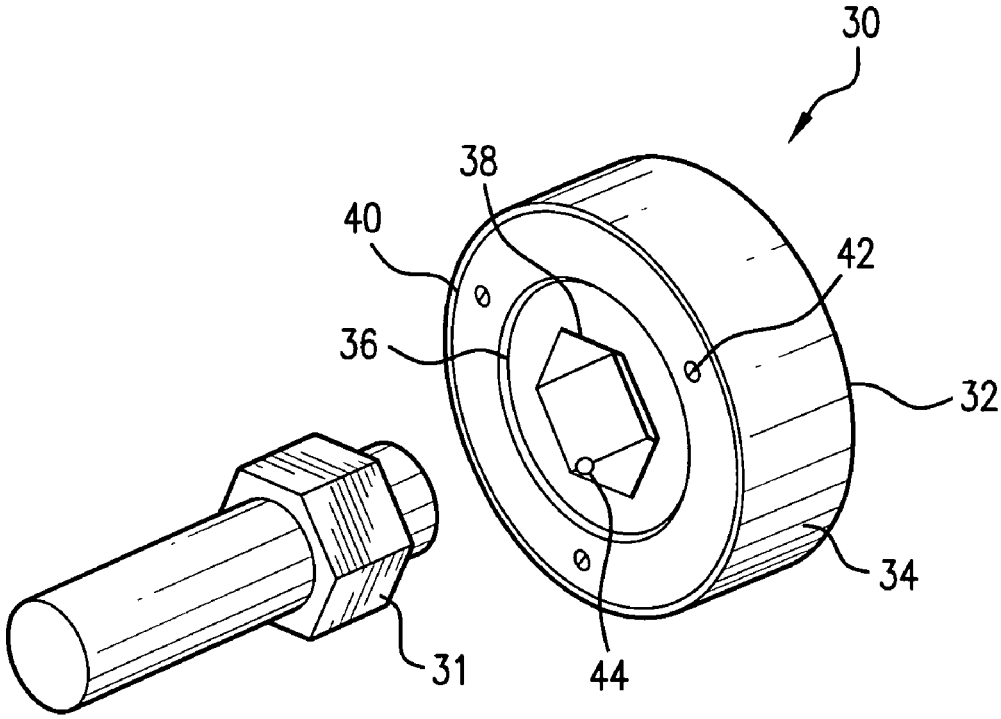
FIG. 1 is a rear and side perspective view of an embodiment of a torque wrench of the present invention and a work object.

Referring to FIG. 1, there is shown an embodiment of a torque wrench 30 of the present invention configured for use on a cable assembly having a hex nut 31 for effecting connection to a corresponding male thread. The torque wrench 30 has an outer ring case 32 which is to be gripped by a user and which has a circumferential surface 34 which is optionally knurled. An inner ring assembly 36 has an hex aperture 38 corresponding to the hex nut 31 which acts as a connector interface structure for accepting the hex nut 31 during tightening thereof. It is understood that although a hex configuration is illustrated, the present invention is not limited thereto and those skilled in the art will appreciate that other configurations, such as square for example, may be used. Furthermore, it is understood that while the hex aperture 38 functions as a female acceptor of the hex nut 31, the present invention further includes the inner ring 36 having a connector interface structure which is of a male configuration, such as that of an Allen key, Phillips head, or straight blade screw driver for use on corresponding fasteners.

The present invention further includes the torque wrench 30 being integrated with cables to form cable assemblies which may be used for testing or for permanent installation. In such configurations the nut of the cable is permanently affixed in the inner ring assembly 36 either mechanically or is integrally formed in the inner ring assembly. Such cable assemblies provide for enhanced repeatability of testing as the torque wrench 30 is mated with the cable to ensure the cable is always tightened to the same torque. It is also within the scope of the present invention to provide test equipment having the torque wrench 30 integrated into connectors on the equipment itself. Once again, enhance repeatability of testing is facilitated.

The torque wrench 30 has a back face plate 40 is secured to the outer ring case 32 by screws 42. The back face plate 40 defines a face plate aperture 41. The back face plate 40 serves to retain the inner ring 36 within the outer 32 along with other components detailed below. A spring loaded ball bearing 44 is optionally provided protruding from a surface of the hex aperture 38 and provides for positive engagement of the hex nut 31.

Figure 2A:
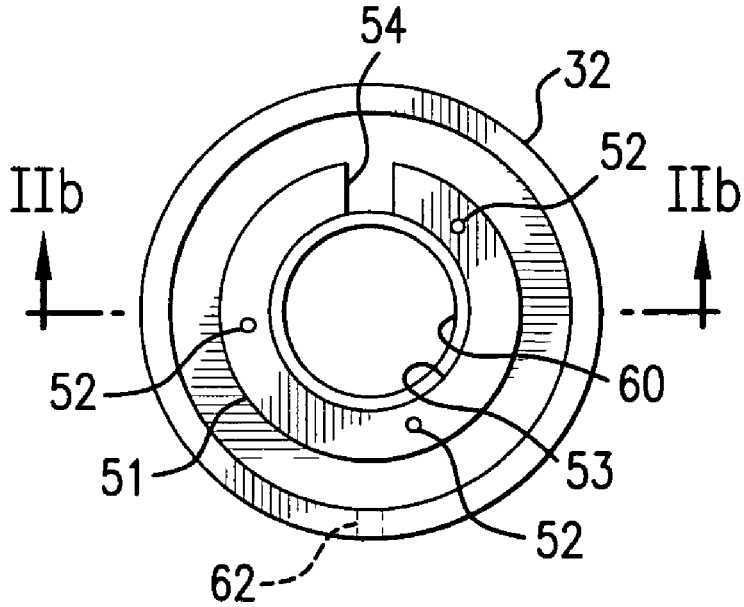
FIG. 2*a* is a rear view of an embodiment of an outer case component of the torque wrench.
Figure 2B:
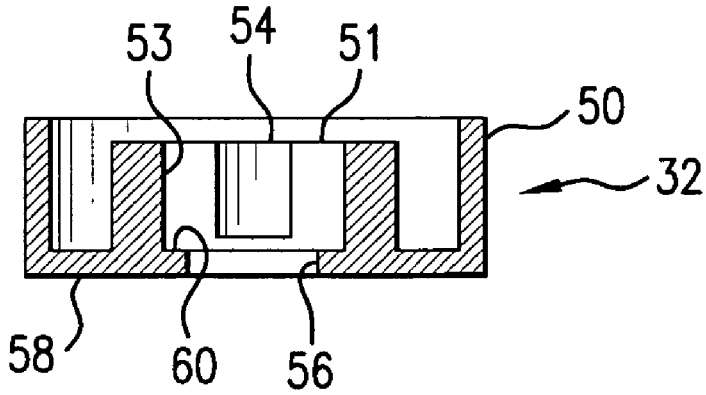
FIG. 2*b* is a side elevation cross-sectional view of the outer case component of the torque wrench of FIG. 2*a* taken along line IIb—IIb.

Referring to FIGS. 2*a* and 2*b*, the outer ring case 32 has an outer ring wall 50 and an inner holding ring 51 in which screw holes 52 are provided for accepting the screws 42 for securing the face plate 40. The inner holding ring 51 rotatably accepts the inner ring assembly 36 within an inner holding ring aperture 53. The inner holding ring 51 extends axially a distance less than the outer ring wall 50 for accepting a thickness of the face plate 40. The inner holding ring 51 further defines a slide notch 54, the details of which are discussed below. The outer ring case 32 further includes a case face plate 58 which defines a case face aperture 56 and is coaxially aligned with the face plate aperture 41 when the face plate 40 is installed. For purposes of clarity in this description, the case face plate 58 will be considered to be the front of the torque wrench 30. An annular portion of the case face plate 58 extending radially inward of the inner holding ring 51 forms a retaining flange 60 which retains the inner ring assembly 36 when installed. A clearance hole 62 is provided in the outer ring wall 50, preferably at a position diametrically opposed to the slide notch 54.

In the preferred embodiment the outer ring case 32 is machined from a block of material, preferably stainless steel. However, other materials may be used and the outer ring case 32 need not be monolithic. It will be realized by those skilled in the art that the outer ring case 32 can optionally be formed of assembled individual parts. For instance, the outer ring wall 50 and the inner holding ring 51 may be separately machined and attached to the case face plate 58 by any of various known means such as screws, welding, brazing or bonding agents, for example. It will be realized also that the outer ring case 32 may be also formed by molding. Such alternative construction techniques may be used provided that desired tolerances, which are dictated by the application, are maintained.

Figure 3A:
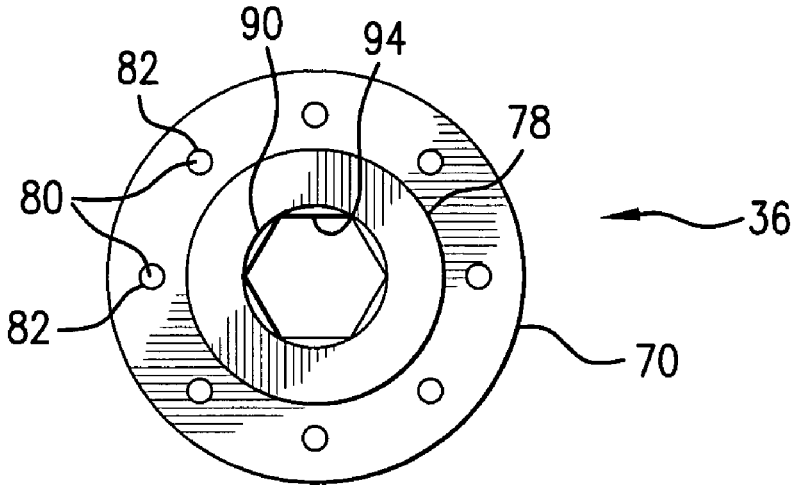
FIG. 3*a* is a front view of an embodiment of an inner ring assembly of the torque wrench.
Figure 3B:
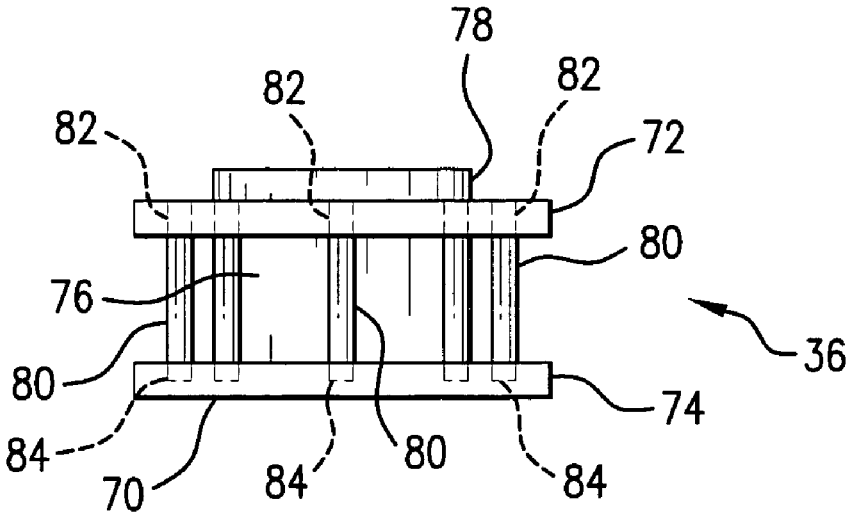
FIG. 3*b* is a side elevation view of the inner ring assembly of the torque wrench of FIG. 3*a;*
Figure 3C:
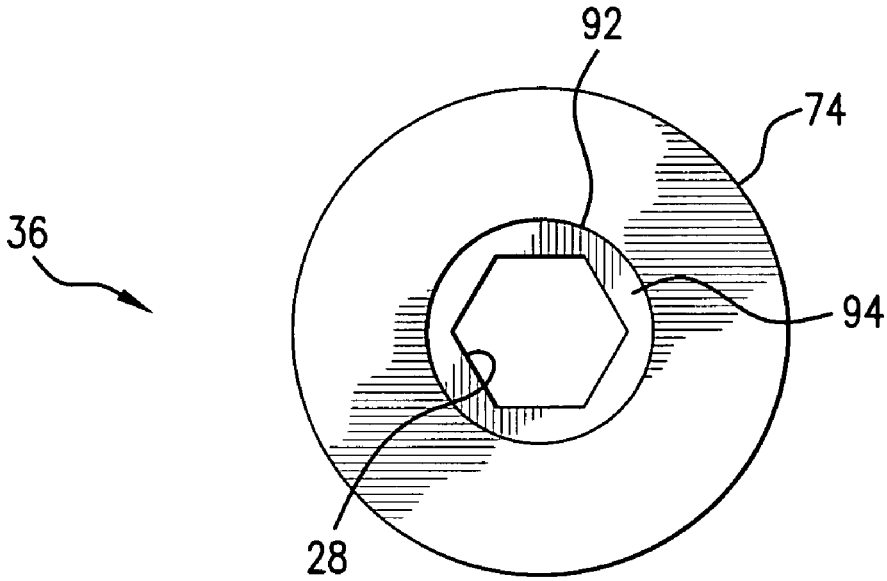
FIG. 3*c* is rear view of the inner ring assembly of the torque wrench of FIG. 3*a;*

Referring to FIGS. 3*a* through 3*c*, the inner ring assembly 36 is shown in detail. It is understood that for purposes of clarity, the figures are not to scale since the inner ring assembly 36 is rotatably disposed within the inner holding ring aperture 53 shown in FIGS. 2*a* and 2*b*. The inner ring assembly 36 includes an inner ring body 70 having a front flange 72, a back flange 74, and an inner ring drum 76. The inner ring body 70 further includes an annular ring 78 which is rotatably disposed in an aperture defined by the retaining flange 60. Roller pins 80 are supported by the front flange 72 and the back flange 74. The front flange 72 has through holes 82 and the back flange 74 has blind holes 84, both of which rotatably accept the roller pins 80. In FIG. 3*a*, certain roller pins 80 and corresponding holes are omitted to permit clear illustration of the inner ring drum 76.

The inner ring body 70 has first and second concentric holes, 90 and 92, of which the second concentric hole 92 has a diameter greater than the first concentric hole 90 such that a step (not shown) is formed within the inner ring body 70. A connector acceptor body 94 is disposed in the second concentric hole 92 and defines the hex aperture 38. In the preferred embodiment, the connector acceptor body 94 is fixedly held in place by a set screw (not shown) threaded in the back flange 74. However, it is realized that other methods known in the art, such as press fitting, brazing, and bonding agents, may be used to secure the connector acceptor body 94, and that the present invention is not limited to methods disclosed herein for securing the connector acceptor body. Furthermore, an embodiment wherein the connector acceptor body 94 and the inner ring body 70 are formed as one piece is also considered to be within the metes and bounds of the present invention.

Figure 4A:
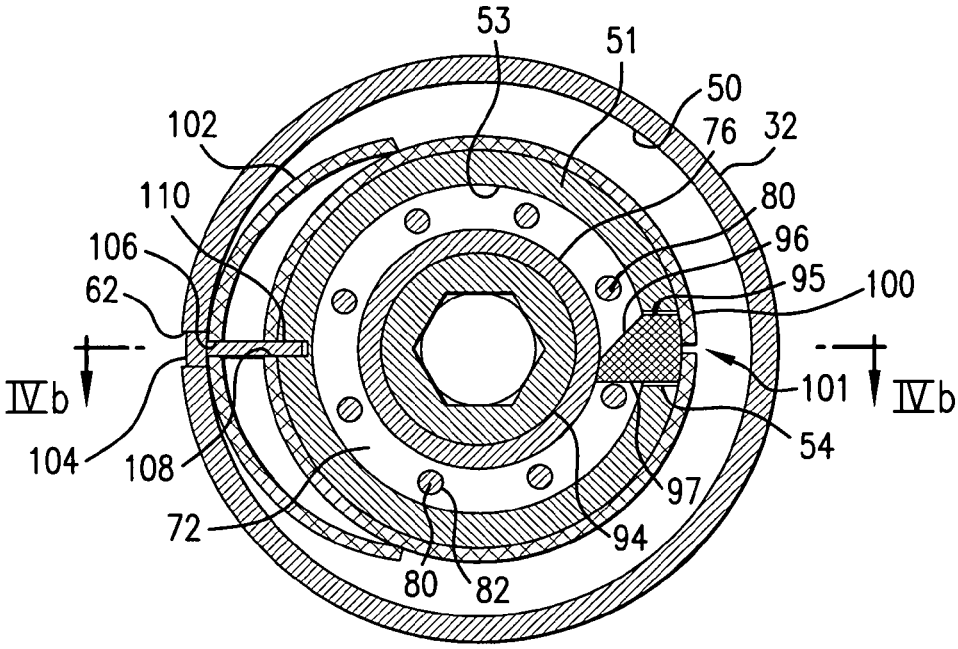
FIG. 4*a* is a rear partially cross-sectional view of the torque wrench of FIGS. 1 and 4*b* taken along line IVa—IVa of FIG. 4*b;*
Figure 4B:
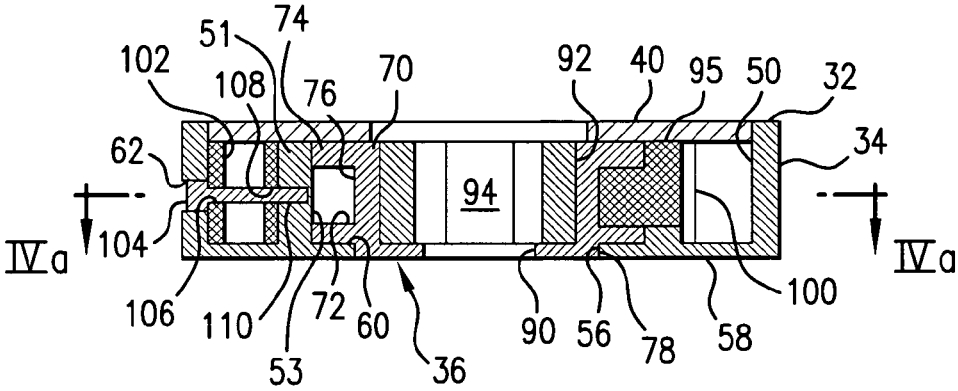
FIG. 4*b* is a side elevation cross-sectional view of the torque wrench of FIG. 4*a* taken along line IVb—IVb.

Referring to FIGS. 4*a* and 4*b*, the torque wrench 30 is shown in cross-sectional views in an assembled state. The inner holding ring assembly 36 is rotatably disposed in the inner holding ring aperture 53 and a slide block 95 is slidably disposed in the slide notch 54. While the inner holding ring 51 is shown as a continuous ring with the exception of the slide notch 54, it is understood that only portions of the inner holding ring 51 sufficient for defining the slide notch 54 and rotatably securing the inner holding ring assembly 36 are required.

A split ring spring 100 surrounds the inner holding ring 51 and biases the slide block 95 radially inward such that a slanted face 96 of the slide block 95 is positioned to engage the roller pins 80 when the inner ring assembly 36 rotates relative to the outer ring case 32. A ring segment spring 102, also known as a leaf spring, is disposed between the outer ring wall 50 and the inner holding ring 51. Although the split ring spring 100 and the ring segment spring 102 are depicted as circular or portions of a circle, such configurations are not required and the springs may be ellipse or have other configurations provided they function as disclosed herein. An adjustment screw 104 passes through the clearance hole 62 and a first spring clearance hole 106 and a second spring clearance hole 108. A threaded hole 110 accepts the adjustment screw 104. In the embodiment shown the first spring clearance hole 106 is preferably centrally positioned in the ring segment spring 102 while the second spring clearance hole 108 is positioned to align a split 101 of the split ring spring 100 with the slide block 95. While in the preferred embodiment the slit ring spring 100 is circular and the ring segment spring 102 is a segment of a circle, it is understood that the present invention is not limited to circular embodiments of these components.

The adjustment screw 104 applies pressure to the ring segment spring 102 which in turn applies bias pressure to opposing sides of the split ring spring 100. The pressure applied to the split ring spring 100 adjusts bias pressure applied to the slide block 95. The torque wrench 30 is engaged with the hex 31 and rotated in the counter clockwise direction in the view of FIG. 4*a* to tighten the hex nut 31. The slanted face 96 of the slide block 95 engages one of the roller pins 80 to transfer torque to the inner ring assembly 36 in order to tighten the hex nut 31. As torque increases, action of the roller pin 80 on the slide block 95 forces the slide block 95 radially outward against the bias pressure applied by the split ring spring 100 until the engaged one of the roller pins 80 rides along the slanted face 96 to a release point where the roller pins 80 rotate pass the slide block 95. At this release point, a requisite amount of torque is applied to the hex nut 31. To loosen the hex nut 31 the torque wrench 30 is rotated in the clockwise direction in the view of FIG. 4*a*. A side face 97 of the slide block 95 engages an opposing one of the roller pins 80 to rotate the inner ring assembly 36 to loosen the hex nut 31.

The amount of torque applied to the hex nut 31 is adjustable by rotation of the adjustment screw 104 and consequent adjustment of pressure applied by the ring segment spring 102 to the split ring spring 100. The further the adjustment screw 104 is threaded into the threaded hole 110, the greater is the torque applied to the hex nut 31.

The split ring spring 100 and the ring segment spring 102 are formed of any material having an elastic modulus sufficient to provide the desired torque without permanent deformation. In a preferred embodiment beryllium copper having a temper of TH04 (formerly HT) is used and machined into the respective components. It will be realized by those skilled in the art that a softer temper, such as TB00 (formerly A) for example, may be machined and then heat treated to a requisite hardness. Beryllium copper provides for temperature insensitivity thereby permitting accurate functioning over a wide range of temperature.

Figure 5A:
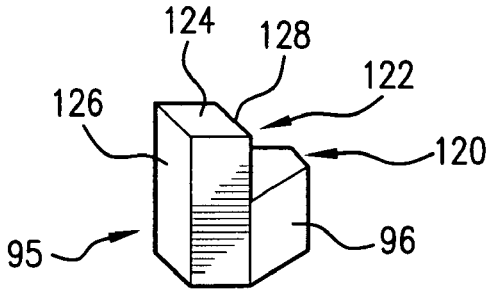
FIG. 5*a* is a top, side and front side perspective view of a slide block of the torque wrench of FIGS. 4*a* and 4*b;*

Referring to FIG. 5*a*, the slide block 95 is shown in a perspective view. The bottom of the slide block 95 is flat and slides on a bottom of the slide notch 54 and an annular surface of the front flange 72 of the inner ring body 70 as shown in FIG. 4*b*. The slanted face 96 is formed on a wedge portion 120 and a top portion 122 extends above the wedge portion 120 a distance such that a top surface 124 thereof is flush with a top surface of the inner holding ring 51 permitting the face plate 40 to slidingly engage the top surface 124 as illustrated in FIG. 4*a*. A back surface 126 and an inner surface 128 are shown formed flat. However, the back surface 126 may be formed curved to match the curvature of the split ring spring 100 and the inner surface 128 may be form curved to match the curvature of the back flange 74 of the inner ring assembly 36.

Component dimensions for an 8 lb-in torque wrench, which is an example of the present invention, follow in Table 1.

TABLE 1

| COMPONENT | DIMENSION (inches) |
|---|---|
| Inner Holding Ring Assembly 36 outer diameter | 0.828 |
| Roller Pins 80 diameter | 0.062 |
| Roller Pins 80 length | 0.316 |
| Front Flange 72 thickness | 0.050 |
| Back Flange 74 thickness | 0.106 |
| Annular Ring 78 diameter | 0.625 |
| First Concentric Hole 90 diameter | 0.325 |
| Second Concentric Hole 92 diameter | 0.50 |
| Separation of Front Flange 72 and Back Flange 74 | 0.185 |
| Inner Ring Drum 76 diameter | 0.628 |
| Outer Ring Case 32 outer diameter | 1.590 |
| Outer Ring Case 32 height | 0.445 |
| Outer Ring Wall 50 inner diameter | 1.491 |
| Inner Holding Ring 51 outer diameter | 1.125 |
| Inner Holding Ring Aperture 53 diameter | 0.830 |
| Case Face Aperture 56 diameter | 0.628 |
| Case Face Plate 56 thickness | 0.045 |
| Split Ring Spring 100 outer diameter | 1.250 |
| Split Ring Spring 100 inner diameter | 1.130 |
| Split Ring Spring 100 height | 0.335 |
| Ring Segment Spring 102 inner radius | 0.58–0.625 |
| Ring Segment Spring 102 wall thickness | 0.040 |
| Ring Segment Spring 102 segment angle | 132°–136°* 192°–196°** |
| Ring Segment Spring 102 height | 0.335 |
| Slide Block 95 width across slide notch 54 | 0.248 |
| Slide Block 95 length in device radial direction | 0.245 |
| Slide Block 95 Slanted Face 96 angle to tangent of device radial direction at center of Slide Block 95 | 20–30° |
| Face Plate 40 outer diameter | 1.490 |
| Face Plate 40 inner diameter | 0.618 |

*For ring segment spring of 0.58"
**For ring segment spring of 0.625"

While the ring segment spring 102 in the above example has a segment angle of 195° in the prototype, the segment angle may be set in the range of about to 132°–136° as noted above. Alternatively, the segment angle is set in a range of 192°–196° for a radius of 0.625". With regard to the split ring spring 100, the ring segment spring 102 engages the split ring spring 100 at engagement points angularly spaced apart as dictated by the above dimensions with respect to the split ring spring 100. While the above dimensions are used in an 8 lb-in torque wrench, it is within the scope and spirit of the present invention for those skilled in the art to alter the dimensional configuration to achieve other torques for testing and alternative applications.

In the torque wrench various lubricants may be used such as light oils, synthetic and natural, silicone lubricant. However, dry graphite powder is preferably used.

Figure 5B:
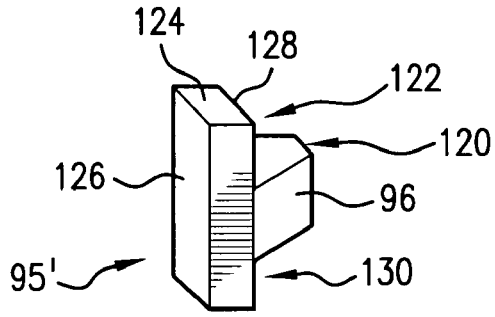
FIG. 5*b* is a top, side and front side perspective view of another embodiment of a slide block of the present invention.
Figure 6A:
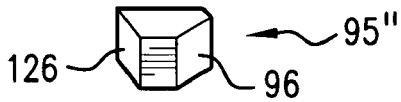
FIG. 6*a* is a top, side and front side perspective view of a further embodiment of a slide block of the present invention.
Figure 6B:
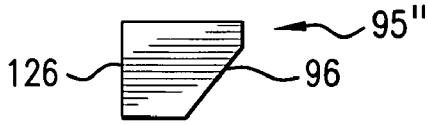
FIG. 6*b* is a top view of the slide block of FIG. 6*a;*
Figure 6C:
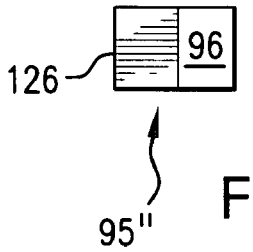
FIG. 6*c* is a front view of the slide block of FIG. 6*a;*
Figure 6D:
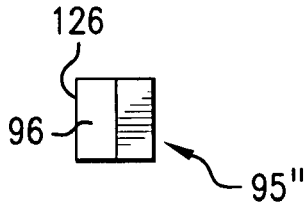
FIG. 6*d* is a side view of the slide block of FIG. 6*a;*

In the embodiment shown in FIGS. 2*a* and 2*b* and FIG. 4*b*, the bottom of the slide notch 54 is at the level of the annular surface of the front flange 72 of the inner ring assembly 36. However, it is realizable that the bottom of the slide notch 54 could alternatively be machined flush with the surface of the retaining flange 60. For such a configuration, a slide block 95' shown in FIG. 5*b* would be used. This is identical to the slide block 95 of FIG. 5*a* except a bottom portion 130 extends below the wedge portion 120 to effect sliding engagement of the bottom of the slide notch machined flush with the surface of the retaining flange 60. Likewise, an inner surface of the bottom portion 130 is optionally formed curved to match the curvature of the front flange 72 of the inner ring assembly 36.

Referring to FIGS. 6*a*–6*d*, a simplified slide block 95" is shown wherein the top portion 122 of the slide block 95 of FIG. 5*a* is omitted. In order for the face plate 40 to provide for a smooth slide motion, retention of the slide block 95" is optionally effected by inclusion of a separate filler block corresponding to the omitted top portion 122.

Figure 7:
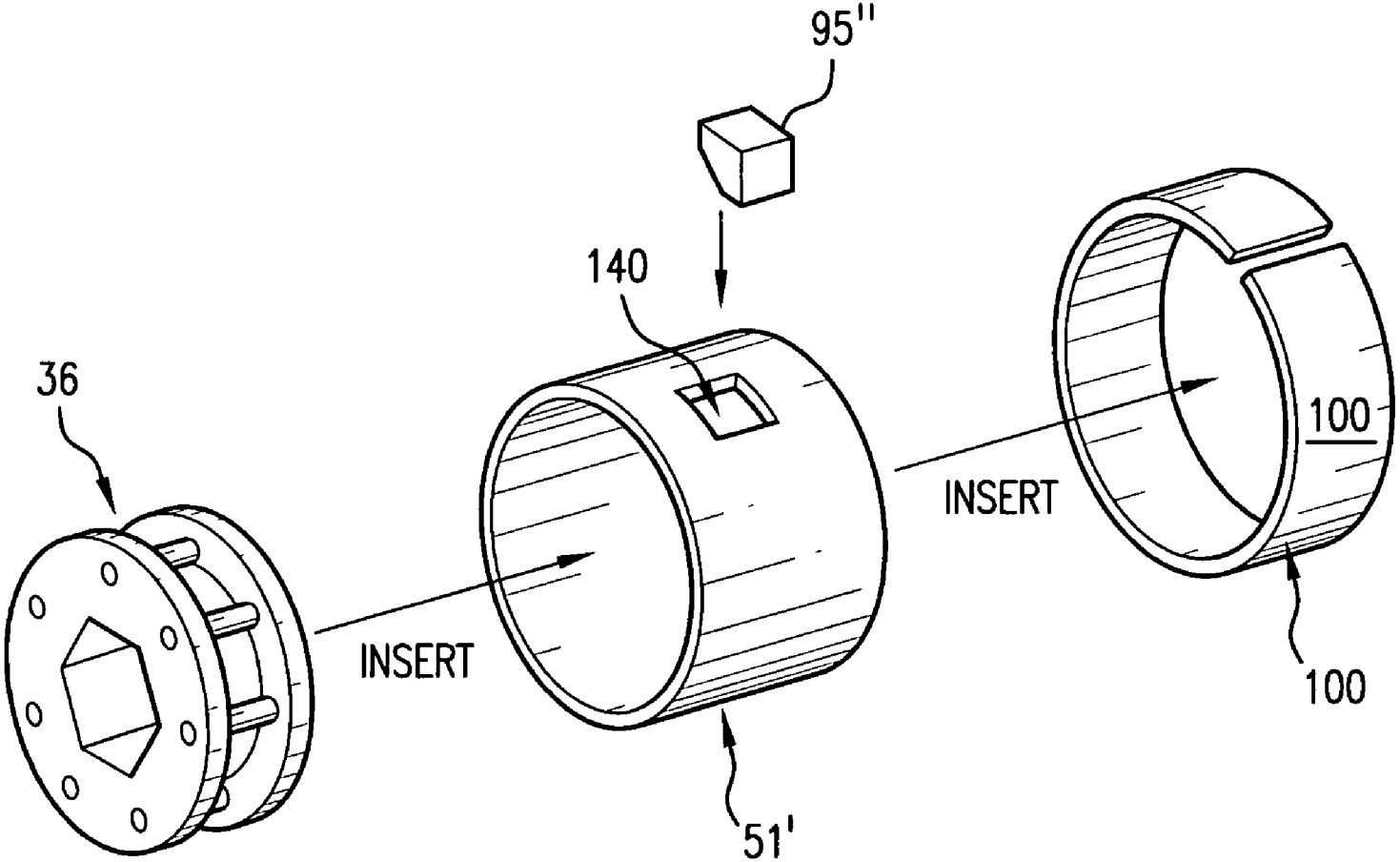
FIG. 7 is a perspective exploded view of a partial assembly of an embodiment of a torque wrench of the present invention.

Referring to FIG. 7, the simplified slide block 95" is alternatively used in conjunction with an inner holding ring 51' formed separately from a remainder of the outer ring case 32 as discussed above. The inner holding ring 51' has a cutout 140 for slidingly accepting the slide block 95". The inner ring assembly 36 is first inserted into the inner holding ring 51'. Next, the slide block 95" is slid into the cutout 140 such that it is substantially flush with an outer surface of the inner holding ring 51' and then the inner holding ring 51' is inserted into the split ring spring 100. The inner holding ring 51' is then installed in the outer ring case 32 using any of aforesaid methods for assembling the outer ring case 32 when formed of separate components. For example, screw through holes (not shown) are provided in the case face plate 58 and screws (not shown) are threaded into corresponding threaded holes (not shown) in the inner holding ring 51'. This is not detailed as one skilled in the art would readily appreciate such an assembly technique in light of the present description. The remainder of the torque wrench 32 is then assembled as shown in FIGS. 4*a* and 4*b*.

Figure 8A:
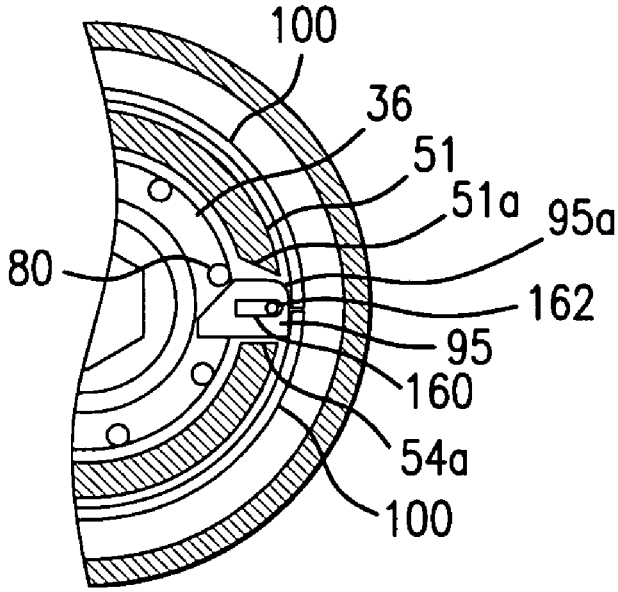
FIG. 8*a* is a rear partial cross-sectional view of another embodiment of the present invention in a first state of operation.
Figure 8B:
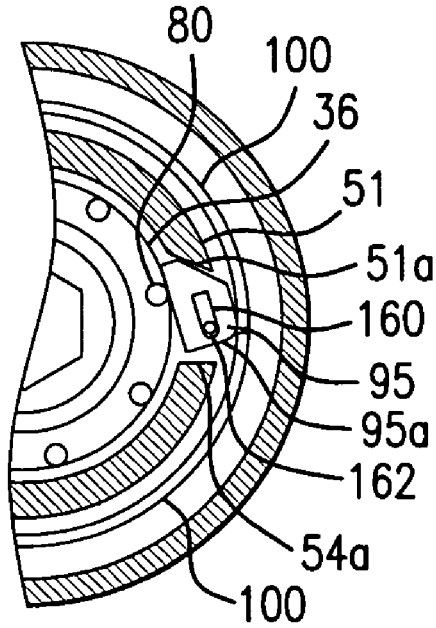
FIG. 8*b* is a rear partial cross-sectional view of the embodiment of the present invention of FIG. 8*a* in a second state of operation.

Referring to FIGS. 8*a* and 8*b*, a further embodiment of the present invention is shown which incorporates a ratcheting feature. The embodiment shown has the features of the above described embodiment except as discussed herein. A slide notch 54*a* is provided which has a slanted face 51*a* on the inner holding ring 51. The slide block 95 has a curved corner 95*a* and a slot 160. A guide pin 162 is disposed in the guide slot 160. Functioning is as described above except that when the inner ring assembly is rotated counter clockwise relative to the inner ring 51, the slide block 95, by virtue of the curved corner 95*a* and the interaction of the guide pin 162 and the guide slot 160, is permitted to rotate out of the way of the roller pin 80 thereby allowing free rotational movement of the inner ring assembly 36 relative to the inner holding ring 51 as shown in FIG. 8*b*. While it is preferred that the slide block 95 have the curve corner 95*a*, it will be realized that the curved corner 95*a* may be omitted provided the split ring spring 100 allows for sufficient deflection to permit rotation of a square corner of the above embodiment of the slide block 95.

Figure 9A:
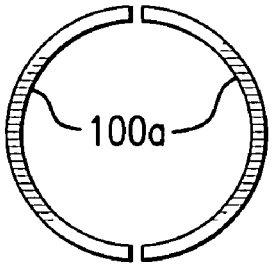
FIG. 9*a* is a first alternative embodiment of a ring spring of the present invention.
Figure 9B:
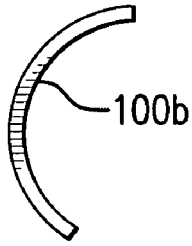
FIG. 9*b* is a second alternative embodiment of the ring spring of the present invention.
Figure 9C:
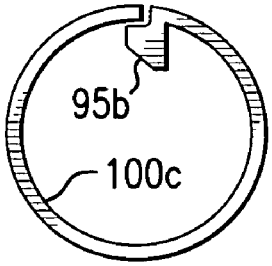
FIG. 9*c* is a third alternative embodiment of the ring spring of the present invention which incorporates a slide block.
Figure 9D:
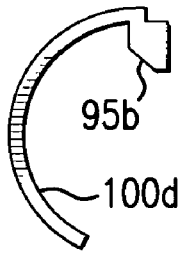
FIG. 9*d* is a fourth alternative embodiment of the ring spring of the present invention which incorporates a slide block.

Referring to FIGS. 9*a* through 9*d*, alternative embodiments of the split ring spring 100 are shown. In a first alternative embodiment a double split ring spring 100*a* is used wherein lower ends thereof are fixed by screws to the inner holding ring 51 or other attachment means which will securely fix the ends. The upper ends are free to flex and the ring segment spring 102 applies pressure to each portion as described above. FIG. 9*b* illustrates a partial split ring spring 100*b* which may used, fixed at the lower end to the inner holding ring 51 with pressure applied either by the ring segment spring 102 or a set screw threaded in the outer ring case in place of the ring segment spring 102. Still further, another embodiment, shown in FIG. 9*c*, provides a split ring spring and block 100*c* with an integral slide block 95*c* which may be substituted for corresponding elements in the above described preferred embodiment. Yet another embodiment, shown in FIG. 9*d*, combines the partial split ring spring 100*b* with the integral guide block 95*b* to form a partial integral split ring spring and block 100*d*. A still further embodiment includes a continuous elastic ring used in place of the split ring spring 100 with or without the ring segment spring 102. When used without the ring segment spring 102, the continuous ring is formed to specifications allowing for the requisite amount of desired torque. One skilled in the art having the benefit of this disclosure can readily select elastic materials to form the continuous ring from. Another alternative also includes forming the continuous ring of an expansion spring which has ends connected by an adjustment screw assembly to variably adjust a distance between ends of the expansion spring and thereby adjust the biasing force of the expansion spring.

Figure 10A:
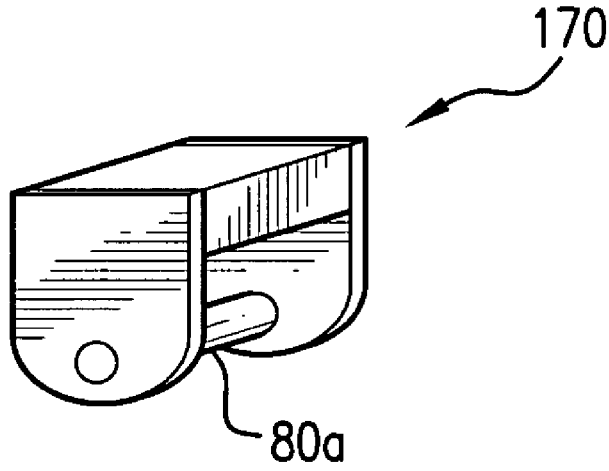
FIG. 10*a* is a top, front and side perspective view of an alternative embodiment of a slide block of the present invention.
Figure 10B:
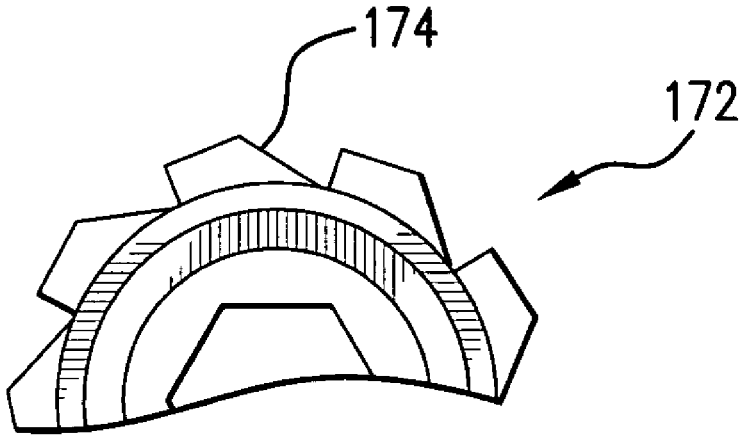
FIG. 10*b* is a front view of a portion of an alternative embodiment of a ring assembly of the present invention for operation in cooperation with the embodiment of the slide block of FIG. 10*a;*

Referring to FIGS. 10*a* and 10*b*, a further embodiment of the present invention is shown wherein the cooperating roller pins 80 of the inner ring assembly 36 and the slanted face 96 of the slide block 95 are interchanged. A slide block 170 is substituted for the slide block 95 and has a roller pin 80*a*, which is optionally rotatably disposed therein, in place of the slanted face 96. The inner ring assembly 36 is replaced with a slanted face ring assembly 172 having slanted faces 174 in place of the roller pins 80. Operation is the same as described above except for the interchangement of the roller pins 80 and the slanted face 96. It is further understood that the slide block 170 may substituted for the slide block 95*a* in FIGS. 8*a* and 8*b* provided the slot 160 is provided therein.

Figure 11:
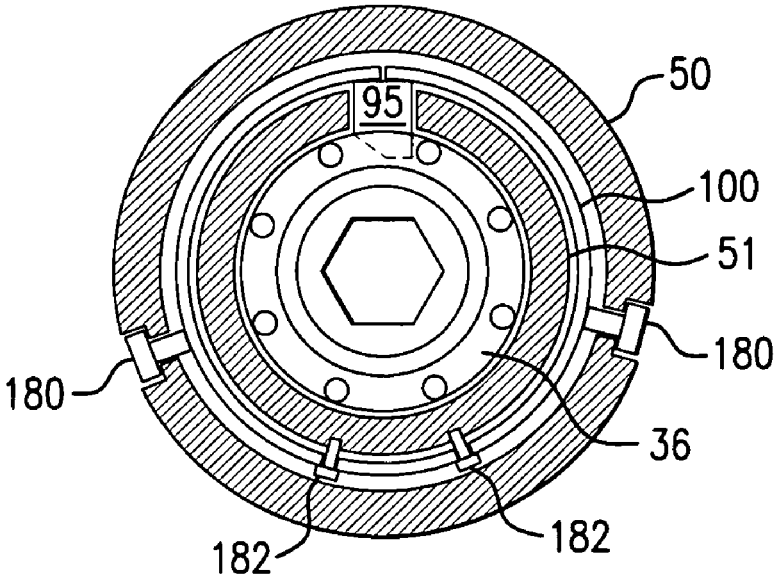
FIG. 11 is rear partial cross-sectional view of an embodiment of the present invention having an alternative biasing mechanism.
Figure 12:
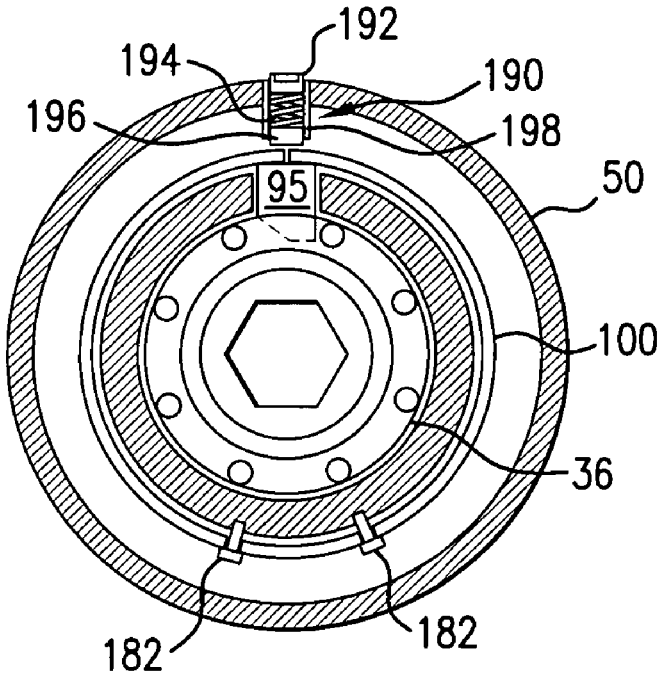
FIG. 12 is rear partial cross-sectional view of an embodiment of the present invention having another alternative biasing mechanism.
Figure 13:
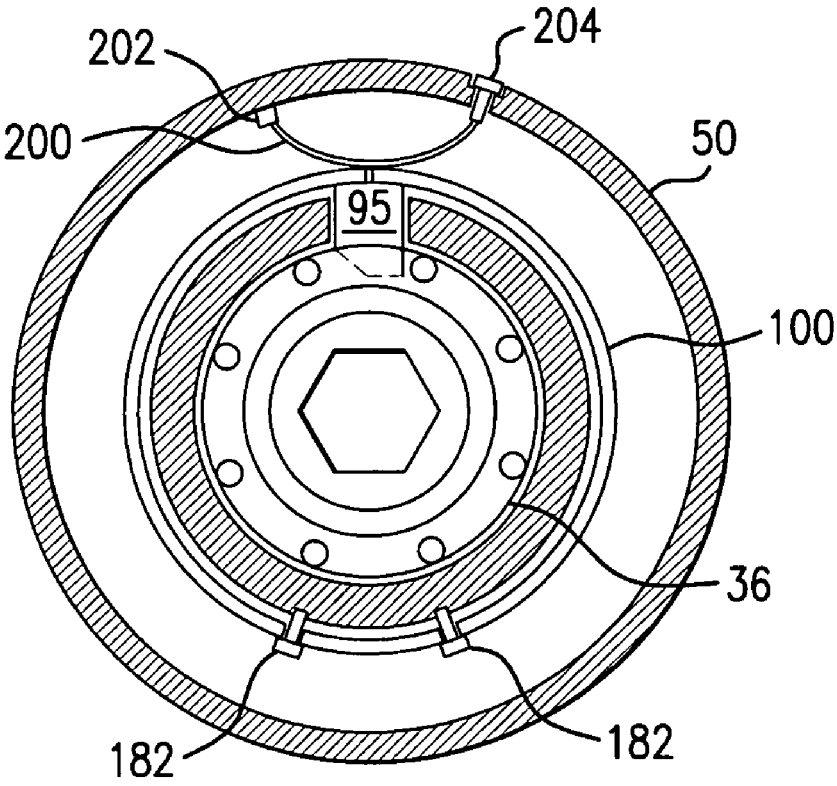
FIG. 13 is rear partial cross-sectional view of an embodiment of the present invention having yet another alternative biasing mechanism.

Referring to FIGS. 11–13, further alternative embodiments of the present invention are shown which are the same as the above described preferred embodiment except as noted herein. In each of these embodiments the ring segment spring 102 and the adjustment screw 104 are omitted and replaced with alternative bias setting arrangements.

Referring to FIG. 11, the ring segment spring 102 is replaced with two bias setting screws 180 threaded in the outer ring wall 50 which apply pressure to the split ring spring 100. The adjustment screw 104 is omitted and the split ring spring 100 is held in place with two screws 182. Of course, it is realized that the two screw 182 may be replaced with a single screw or other fixing device or technique. It is understood that the split ring spring 100 has an inner diameter slightly larger than the outer diameter of the inner holding ring 51 to permit the two screws 180 to variably deflect the split ring spring 100 to thereby adjust the bias on the slide block 95.

Referring to FIG. 12, another embodiment of the present invention is shown wherein the split ring spring 100 is again held in place with the two screws 182. A compression spring assembly 190 is provided in the outer ring wall 50 and has a set screw 192 threaded therein, a compression spring 194, and a pusher block 194 in a tube 198. The set screw 192 is then used to variably adjust the bias pressure of the slide block 95. It will also be realized that the thickness of the outer ring wall 50 may be increased and the tube 198 omitted. In such a configuration, the outer ring wall 52 will have a bore acting as the tube 198 and a threaded portion engaging the set screw 192. It is further understood that the slide block 170 may be used in combination with the compression spring assembly 190.

Referring to FIG. 13, another embodiment of the present invention is shown wherein the split ring spring 100 is again held in place with the two screws 182. A leaf spring 200 is fixed at one end by a fixing block 202 to the outer ring wall 50. Epoxies, or spot welding may be used. Alternatively, a notched may be formed in the outer ring wall 50 to accept the end of the leaf spring 200. An adjustment screw 204 is threaded in the outer ring wall 50 and is used to adjust the pressure of the leaf spring 200 applied to the split ring spring 100.

Figure 14:
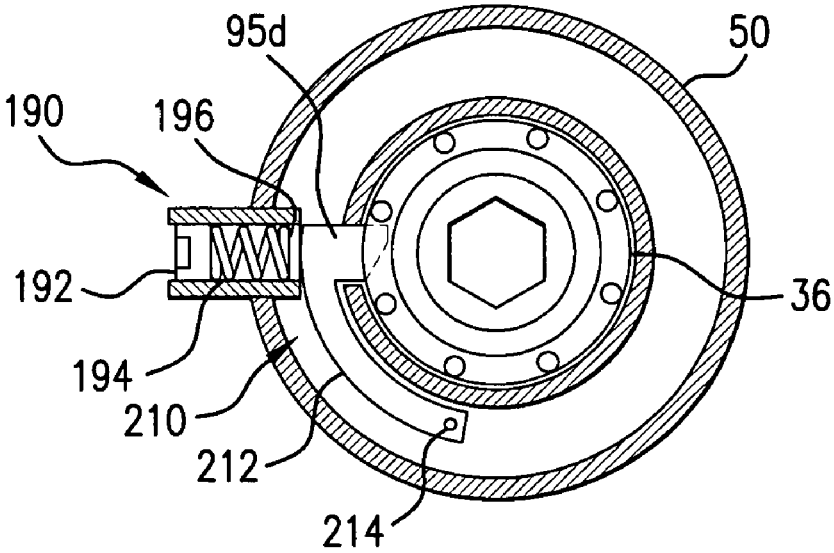
FIG. 14 is rear partial cross-sectional view of an embodiment of the present invention having still another alternative biasing mechanism.
Figure 15:
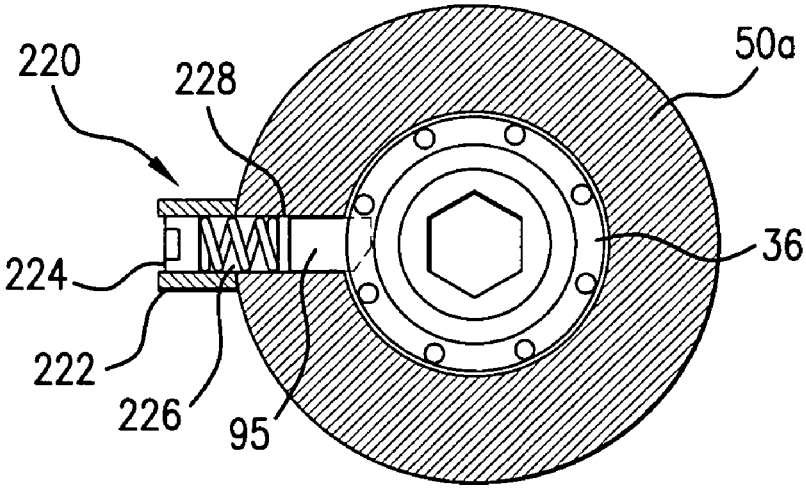
FIG. 15 is rear partial cross-sectional view of another embodiment of the present invention having an alternative slide block embodiment cooperating with the alternative biasing mechanism of FIG. 12.

Referring to FIGS. 14 and 15, two further alternative embodiments of the present invention are shown which are the same as the above described preferred embodiment except as noted herein. In each of these embodiments the split ring spring 100, the ring segment spring 102, and the adjustment screw 104 are omitted and replaced with alternative bias setting arrangements.

Referring to FIG. 14, the compression spring assembly 190 is installed in the outer ring wall 50. An integral slide block and arm 210 is provided and includes an integral slide block 95*d* and pivot arm 212 pivotably mounted by pivot pin 214. The set screw 192 is adjusted to then set the proper desired bias on the integral slide block 95*d*. Alternative, the integral slide block and arm 210 may incorporated the slide block 170 to operate with the slanted face ring assembly 172.

Referring to FIG. 15, the outer ring wall 50 and the inner holding ring 51 are combined to form an outer ring wall 50*a* which rotatably holds the inner ring assembly 36. A set screw assembly 220 has a threaded tube 222 threaded to receive a set screw 224 which applies pressure to a compression spring 226 which acts on the slide block 95 via a pusher block 228. The set screw 224 is adjusted to then set the proper desired bias on the slide block 95. It is further understood that the slide block 170 may be used in combination with the set screw assembly 220.

Figure 16A:
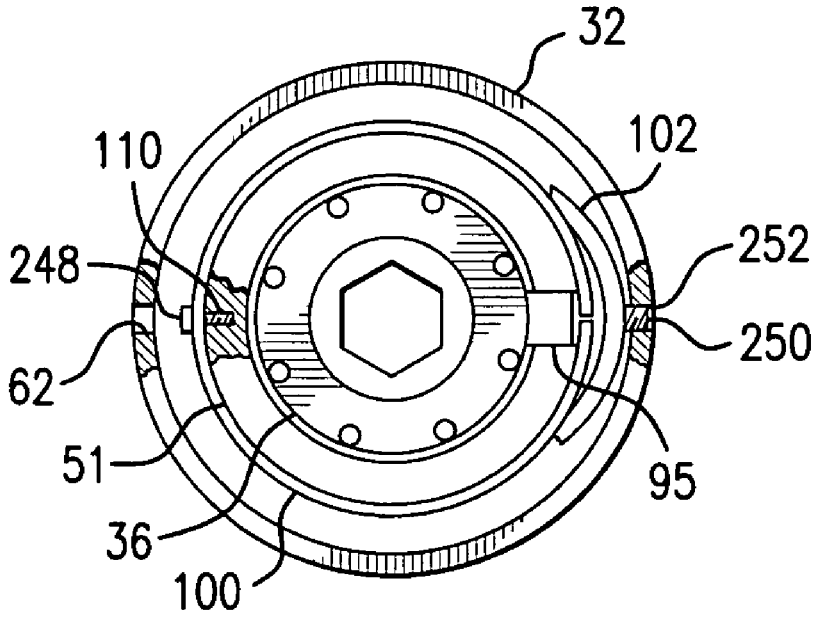
FIG. 16*a* is rear partial cross-sectional view of another embodiment of the present invention having an alternative biasing configuration.
Figure 16B:
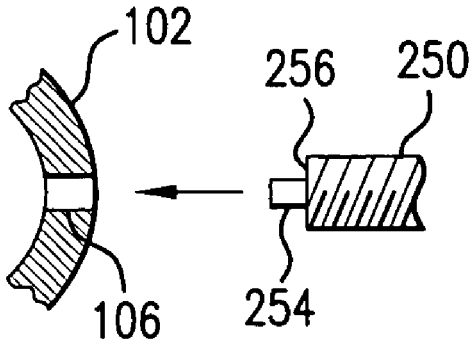
FIG. 16*b* is an exploded view of an assembly of the alternative biasing configuration of FIG. 16*a* showing a cross-section view of a ring segment spring and a set screw.

Referring to FIGS. 16*a* and 16*b*, another alternative embodiment of the present invention is shown which is the same as the embodiment of FIGS. 1–4*b* except as noted herein. The positioning of the ring segment spring 102 is changed to the side of the slide block 95 and the split ring spring 100 is held in place by a screw 248 threaded into the threaded hole 110. An adjustment set screw 250 is threaded into a threaded hole 252 and is adjusted to provide the desired amount of bias to the split ring spring 100 via the ring segment spring 102. This adjustment varies the bias applied to the slide block 95 by the split ring spring 100 to thereby adjust the torque applied by the torque wrench.

Referring to FIG. 16*b*, engagement of the ring segment spring 102 by the adjustment set screw 250 is shown. An end of the adjustment set screw 250 is machined to provide a pin 254 which rotatably fits into the first clearance hole 106 of the ring segment spring 102. Accordingly, the ring segment spring 102 is prevented from circumferentially shifting in the outer ring case 32 by the pin 254 and a shoulder 256 applies radial pressure to the ring segment spring 102. It is further realizable that a blind hole may be provided in the ring segment spring 102 to rotatably accept a standard threaded end of the adjustment set screw 250.

It is understood that the present invention includes all combinations of the above alternative embodiments of biasing mechanisms, slide blocks, and combinations thereof. For example, each of the alternative embodiments of the slide block may be used in combination with any of the alternative embodiments of the bias mechanisms except for where to two are combined such as in FIGS. 9*c* and 9*d*. Likewise, the alternative embodiments of the split ring springs of FIGS. 9*a*–9*d* may be used with any of the bias adjustment embodiments of FIGS. 11–13 and 15. Still further of the alternative embodiment of the inner ring assembly and slide block of FIGS. 10*a* and 10*b* may be used with any of the aforesaid biasing arrangements with appropriate substitution of parts.

Having described preferred embodiments of the invention with reference to the accompanying drawings, it is to be understood that the invention is not limited to those precise embodiments, and that various changes and modifications may be effected therein by one skilled in the art without departing from the scope or spirit of the invention as defined in the appended claims.

What is claimed is:

1. A torque device for applying torque to a rotatable member, comprising:

a housing;

an inner ring assembly defining a torque axis upon which torque is to be applied, said inner ring assembly including at least one pin eccentrically disposed relative to said torque axis and an engaging structure coaxially disposed relative said torque axis for engaging said rotatable member;

said housing rotatably accepting said inner ring assembly to permit rotation about said torque axis;

a movable member disposed in said housing to move along a travel path to come into and out of engagement with said at least one pin when said inner ring assembly rotates relative said housing to rotate said a least one pin along a circumferential path of travel about said torque axis and relative to said housing;

said movable member having a slanted face slanted relative to a tangent to an intersection of said circumferential path of travel of said at least one pin and the travel path of said movable member thereof such that continued rotation in a first direction of said inner ring assembly, relative to said housing, engages said slanted face with said at least one pin and urges said movable member outward relative to said torque axis to a disengagement point where said slanted face moves out of engagement with said at least one pin; and an adjustable biasing device for biasing said movable member toward said at least one pin such that said inner ring assembly applies a predetermined level of torque to said rotatable member at said point of disengagement.

2. The torque device of claim 1 wherein said movable member is a sliding member slidably disposed in said housing.

3. The torque device of claim 2, wherein:

said adjustable biasing device includes a split ring spring;

said housing defines a slide notch for slidably accepting said sliding member; and said housing further defines a circumferential opening accepting said split ring spring such that said split ring spring is disposed around said inner ring assembly and an inner circumference of said split ring spring engages a sliding member end of said sliding member, opposing said slanted face, to apply bias to said sliding member to engage said at least one pin with said slanted face.

4. The torque device of claim 3, wherein said split ring spring is integral with said sliding member.

5. The torque device of claim 3, wherein:

said biasing device includes a ring segment spring having first and second ends, the ring segment spring being disposed in said circumferential opening radially outside of said split ring spring with said first and second ends engaging an outer circumference of said split ring spring at first and second points; and said biasing device further includes a threaded member threaded into said housing and disposed to adjustably apply pressure to said ring segment spring such that said first and second ends of said ring segment spring apply adjustable pressure to said first and second points on said outer circumference of said split ring spring.

6. The torque device of claim 5, wherein said at least one pin is rotatably disposed in said inner ring assembly.

7. The torque device of claim 3, wherein said at least one pin includes a plurality of pins circumferentially disposed in said inner ring assembly.

8. The torque device of claim 7, wherein said plurality of pins are rotatably disposed in said inner ring assembly.

9. The torque device of claim 2, wherein said adjustable biasing device includes a threaded member and a compression spring with said threaded member disposed to adjustably apply force to said compression spring which in turn applies said bias to said sliding member.

10. The torque device of claim 1 wherein said movable member is a pivoting member pivotably disposed in said housing.

11. The torque device of claim 10, wherein:

said adjustable biasing device includes a split ring spring; and said housing further defines a circumferential opening accepting said split ring spring such that said split ring spring is disposed around said inner ring assembly and an inner circumference of said split ring spring engages a pivoting member end of said pivoting member, opposing said slanted face, to apply bias to said pivoting member to engage said at least one pin with said slanted face.

12. The torque device of claim 11, wherein:

said biasing device includes a ring segment spring having first and second ends, the ring segment spring being disposed in said circumferential opening radially outside of said split ring spring with said first and second ends engaging an outer circumference of said split ring spring at first and second points; and said biasing device further includes a threaded member threaded into said housing and disposed to adjustably apply pressure to said ring segment such that said first and second ends of said ring segment spring apply adjustable pressure to said first and second points on said outer circumference of said split ring spring.

13. The torque device of claim 11, wherein said at least one pin is rotatably disposed in said inner ring assembly.

14. The torque device of claim 11, wherein said at least one pin includes a plurality of pins circumferentially disposed in said inner ring assembly.

15. The torque device of claim 14, wherein said plurality of pins are rotatably disposed in said inner ring assembly.

16. The torque device of claim 10, wherein said adjustable biasing device includes a threaded member and a compression spring with said threaded member disposed to adjustably apply force to said compression spring which in turn applies said bias to said pivoting member.

17. The torque device of claim 1 further comprising:

a guide pin disposed in said housing;

said housing defining a slide notch for slidably accepting said movable member;

said movable member being a sliding member slidably disposed in the slide notch defined by said housing and said sliding member having a longitudinal slot aligned along a sliding axis of said sliding member;

said guide pin being disposed within said longitudinal slot;

and said slide notch being configured to restrict sliding movement of said sliding member to a linear path when said rotation of said inner ring assembly is rotated relative said housing in the first direction and configured to permit rotation of said sliding member about said guide pin by engagement of the at least one pin with the sliding member with rotation of the inner ring assembly in a second direction, opposite said first direction, such that disengagement of said sliding member with said at least one pin is permitted by continued rotation of said inner ring assembly in said second direction thereby effecting ratcheting operation of said inner ring assembly relative to said housing.

18. The torque device of claim 17, wherein:

said adjustable biasing device includes a split ring spring; and said housing further defines a circumferential opening accepting said split ring spring such that said split ring spring is disposed around said inner ring assembly and an inner circumference of said split ring spring engages a sliding member end of said sliding member, opposing said slanted face, to apply bias to said sliding member to engage said at least one pin with said slanted face.

19. The torque device of claim 18, wherein:

said biasing device includes a ring segment spring having first and second ends, the ring segment spring being disposed in said circumferential opening radially outside of said split ring spring with said first and second ends engaging an outer circumference of said split ring spring at first and second points; and said biasing device further includes a threaded member threaded into said housing and disposed to adjustably apply pressure to said ring segment such that said first and second ends of said ring segment spring apply adjustable pressure to said first and second points on said outer circumference of said split ring spring.

20. The torque device of claim 19, wherein said at least one pin is rotatably disposed in said inner ring assembly.

21. The torque device of claim 18, wherein said at least one pin includes a plurality of pins circumferentially disposed in said inner ring assembly.

22. The torque device of claim 21, wherein said plurality of pins are rotatably disposed in said inner ring assembly.

23. The torque device of claim 1, wherein said adjustable biasing device includes a threaded member and a compression spring with said threaded member disposed to adjustably apply force to said compression spring which in turn applies said bias to said movable member.

24. The torque device of claim 1, wherein:

said adjustable biasing device includes a split ring spring; and said housing further defines a circumferential opening accepting said split ring spring such that said split ring spring is disposed around said inner ring assembly and an inner circumference of said split ring spring engages said movable member to apply bias to said movable member to engage said at least one pin with said slanted face.

25. The torque device of claim 24, wherein said split ring spring is connected to said movable member.

26. A torque device for applying torque to a rotatable member, comprising:

a housing;

an inner ring assembly defining a torque axis upon which torque is to be applied, said inner ring assembly including at least one first engaging surface eccentrically disposed relative to said torque axis and an engaging structure coaxially disposed relative said torque axis for engaging said rotatable member;

said housing rotatably accepting said inner ring assembly to permit rotation about said torque axis;

a movable member disposed in said housing and having a second engaging surface disposed to move along a travel path to come into and out of engagement with said at least one first engaging surface when said inner ring assembly rotates relative said housing to rotate said a least one first engaging surface along a circumferential path of travel about said torque axis and relative to said housing;

said at least one first and second engaging surfaces being disposed to effect engagement along a surface path slanted relative to a tangent to an intersection of said circumferential path of travel of said at least one first engaging surface and a path of travel said movable member in a moving direction thereof such that continued rotation in a first direction of said inner ring assembly, relative to said housing, engages said second engaging surface with said at least one first engaging surface and urges said movable member outward relative to said torque axis to a disengagement point where said second engaging surface moves out of engagement with said at least one first engaging surface; and an adjustable biasing device for biasing said movable member toward said at least one first engaging surface such that said inner ring assembly applies a predetermined level of torque to said rotatable member at said point of disengagement, said adjustable biasing device including a split ring spring disposed around said inner ring assembly and an inner circumference of said split ring spring engages said movable member opposing said second engaging surface so as to apply bias to said movable member to engage said second engaging surface with said at least one first engaging surface.

27. The torque device of claim 26 wherein said movable member is a sliding member slidably disposed in said housing.

28. The torque device of claim 27, wherein:

said housing defines a slide notch for slidably accepting said sliding member; and said housing further defines a circumferential opening accepting said split ring spring such that said split ring spring is disposed around said inner ring assembly and the inner circumference of said split ring spring engages a sliding member end of said sliding member.

29. The torque device of claim 28, wherein said split ring spring is integral with said sliding member.

30. The torque device of claim 28, wherein:

said biasing device includes a ring segment spring having first and second ends, the ring segment spring being disposed in said circumferential opening radially outside of said split ring spring with said first and second ends engaging an outer circumference of said split ring spring at first and second points; and said biasing device further includes a threaded member threaded into said housing and disposed to adjustably apply pressure to said ring segment spring such that said first and second ends of said ring segment spring apply adjustable pressure to said first and second points on said outer circumference of said split ring spring.

31. The torque device of claim 30, wherein said second engaging surface is a surface of a pin is rotatably disposed in said sliding member and said at least one first engaging surface is a surface disposed at an incline relative to a radial direction of said inner ring assembly.

32. The torque device of claim 26 wherein said movable member is a pivoting member pivotably disposed in said housing.

33. The torque device of claim 32, wherein said housing further defines a circumferential opening accepting said split ring spring such that said split ring spring is disposed around said inner ring assembly and an inner circumference of said split ring spring engages a pivoting member end of said pivoting member.

34. The torque device of claim 33, wherein:

said biasing device includes a ring segment spring having first and second ends, the ring segment spring being disposed in said circumferential opening radially outside of said split ring spring with said first and second ends engaging an outer circumference of said split ring spring at first and second points; and said biasing device further includes a threaded member threaded into said housing and disposed to adjustably apply pressure to said ring segment such that said first and second ends of said ring segment spring apply adjustable pressure to said first and second points on said outer circumference of said split ring spring.

35. The torque device of claim 34, wherein said second engaging surface is a surface of a pin rotatably disposed in said sliding member and said at least one first engaging surface is a surface disposed at an incline relative to a radial direction of said inner ring assembly.

36. The torque device of claim 33, wherein said second engaging surface is a surface of a pin rotatably disposed in said sliding member and said at least one first engaging surface is a surface disposed at an incline relative to a radial direction of said inner ring assembly.

37. The torque device of claim 26, wherein said split ring spring is connected to said movable member.

38. A cable assembly comprising:

a cable;

a threaded connector having a rotatable threaded member; and a torque device for applying torque to a rotatable member, comprising:

a housing;

an inner ring assembly defining a torque axis upon which torque is to be applied, said inner ring assembly including at least one pin eccentrically disposed relative to said torque axis and an engaging structure coaxially disposed relative said torque axis for engaging said rotatable member;

said housing rotatably accepting said inner ring assembly to permit rotation about said torque axis;

a movable member disposed in said housing to move along a travel path to come into and out of engagement with said at least one pin when said inner ring assembly rotates relative said housing to rotate said a least one pin along a circumferential path of travel about said torque axis and relative to said housing;

said movable member having a slanted face slanted relative to a tangent to an intersection of said circumferential path of travel of said at least one pin and the travel path of said movable member thereof such that continued rotation in a first direction of said inner ring assembly, relative to said housing, engages said slanted face with said at least one pin and urges said movable member outward relative to said torque axis to a disengagement point where said slanted face moves out of engagement with said at least one pin; and an adjustable biasing device for biasing said movable member toward said at least one pin such that said inner ring assembly applies a predetermined level of torque to said rotatable member at said point of disengagement, wherein said rotatable threaded member is said rotatable member and said engaging structure is fixed to said rotatable member.

39. The cable assembly of claim 38 wherein said engaging structure and said rotatable member are integral.

40. A cable assembly comprising:

a cable;

a threaded connector having a rotatable threaded member;

a torque device for applying torque to a rotatable member, comprising:

a housing;

an inner ring assembly defining a torque axis upon which torque is to be applied, said inner ring assembly including at least one first engaging surface eccentrically disposed relative to said torque axis and an engaging structure coaxially disposed relative said torque axis for engaging said rotatable member;

said housing rotatably accepting said inner ring assembly to permit rotation about said torque axis;

a movable member disposed in said housing and having a second engaging surface disposed to move along a travel path to come into and out of engagement with said at least one first engaging surface when said inner ring assembly rotates relative said housing to rotate said a least one first engaging surface along a circumferential path of travel about said torque axis and relative to said housing;

said at least one first and second engaging surfaces being disposed to effect engagement along a surface path slanted relative to a tangent to an intersection of said circumferential path of travel of said at least one first engaging surface and a path of travel said movable member in a moving direction thereof such that continued rotation in a first direction of said inner ring assembly, relative to said housing, engages said second engaging surface with said at least one first engaging surface and urges said movable member outward relative to said torque axis to a disengagement point where said second engaging surface moves out of engagement with said at least one first engaging surface; and an adjustable biasing device for biasing said movable member toward said at least one first engaging surface such that said inner ring assembly applies a predetermined level of torque to said rotatable member at said point of disengagement, said adjustable biasing device including a split ring spring disposed around said inner ring assembly and an inner circumference of said split ring spring engages said movable member opposing said second engaging surface so as to apply bias to said movable member to engage said second engaging surface with said at least one first engaging surface, wherein said rotatable threaded member is said rotatable member and said engaging structure is fixed to said rotatable member.

41. The cable assembly of claim 40 wherein said engaging structure and said rotatable member are integral.

* * * * *